United States Patent [19]

Griffiths

[11] 4,062,530

[45] Dec. 13, 1977

[54] OXYGEN-LIME DISTRIBUTOR FOR STEELMAKING VESSEL

[75] Inventor: David Kallom Griffiths, Penn Hills Township, Allegheny County, Pa.

[73] Assignee: United States Steel Corporation, Pittsburgh, Pa.

[21] Appl. No.: 775,082

[22] Filed: Mar. 7, 1977

[51] Int. Cl.[2] ..... C21C 5/48

[52] U.S. Cl. ..... 266/222

[58] Field of Search ..... 266/221, 222, 243, 267, 266/268

[56] References Cited

FOREIGN PATENT DOCUMENTS 544,393 2/1932 Germany ..... 266/267

*Primary Examiner*—Gerald A. Dost

*Attorney, Agent, or Firm*—John F. Carney

[57] ABSTRACT

Excessive wear is eliminated in a distributor utilized in a bottom-blown oxygen steelmaking converter for distributing oxygen and entrained lime to the converter tuyeres by the provision of a spiral ramp that extends between the inlet and outlet regions of the affected portion of the distributor. The ramp is arranged to mechanically separate the entering oxygen-lime mixture from that flowing through the affected region thereby preventing the interference between the two flows and the wear-producing flow acceleration attendant therewith.

13 Claims, 5 Drawing Figures

OXYGEN-LIME DISTRIBUTOR FOR STEELMAKING VESSEL

BACKGROUND

During the refining of steel by the bottom-blown oxygen process, commonly referred to as the Q-BOP process, oxygen containing entrained particles of lime is blown upwardly through tuyeres that communicate with the vessel interior below the level of molten metal therein. Each tuyere is enclosed by a concentric pipe for the simultaneous injection of shielding fluid such as natural gas, propane or other liquid or gaseous hydrocarbon, which acts as a coolant and delays contact between oxygen and the molten metal adjacent the tuyere outlets to retard tuyere erosion.

Typically a Q-BOP vessel is provided with upwards of twelve tuyeres. The tuyeres are disposed such that their openings to the vessel interior define a diametral swath across the vessel bottom. In order to insure uniform distribution of oxygen and entrained lime to each tuyere, the materials are delivered to a distribution manifold that is secured to the vessel bottom and from which feeder lines extend to each of the respective tuyeres. The distribution manifold is a hollow cylindrical body that is divided into two vertically spaced portions that are mutually connected by an axial connector tube. The oxygen-lime suspension is supplied tangentially into the upper portion and induced by cyclonic action to enter the connector tube for delivery to the lower portion from whence it exits the manifold through feeder lines that connect with the manifold through radial openings in the wall thereof.

Distributor manifolds of the described type suffer from the disadvantage of having a relatively brief useful life caused by undue wear that occurs on the interior surface thereof due to the abrasive effect of the high velocity lime particles on the wall surface. The region of most acute wear occurs on that part of the interior wall located immediately downstream of the point of tangency of the inlet pipe and can be attributed to the pinch effect produced by the recirculated portion of the fluid suspension that does not flow into the connector tube during its first traverse of the manifold interior. The recirculated portion of the fluid suspension, in flowing past the tangential inlet opening to the manifold, causes a restriction in the fluid flow path of the entering stream which increases the flow velocity of the fluid suspension and thereby aggravates the abrasive effect the lime particles have on surface wear.

It is to the improvement of such distribution manifolds therefore that the present invention is directed.

SUMMARY

According to the present invention, there is provided a distribution manifold particularly adapted for use in a converter for refining metal by a bottom-blown oxygen process comprising a hollow cylindrical body, means dividing the interior of said body into axially spaced portions, means connecting said portions into mutual fluid communication, inlet means for introducing supply fluid to one of said portions and for imparting a spinning motion therein whereby said fluid is induced by cyclonic action to traverse a path from said one portion through said connecting means to the other of said portions, means for discharging supply fluid from the other of said portions and baffle means diverting the path of fluid flow away from registry with supply fluid introduced through said inlet means.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
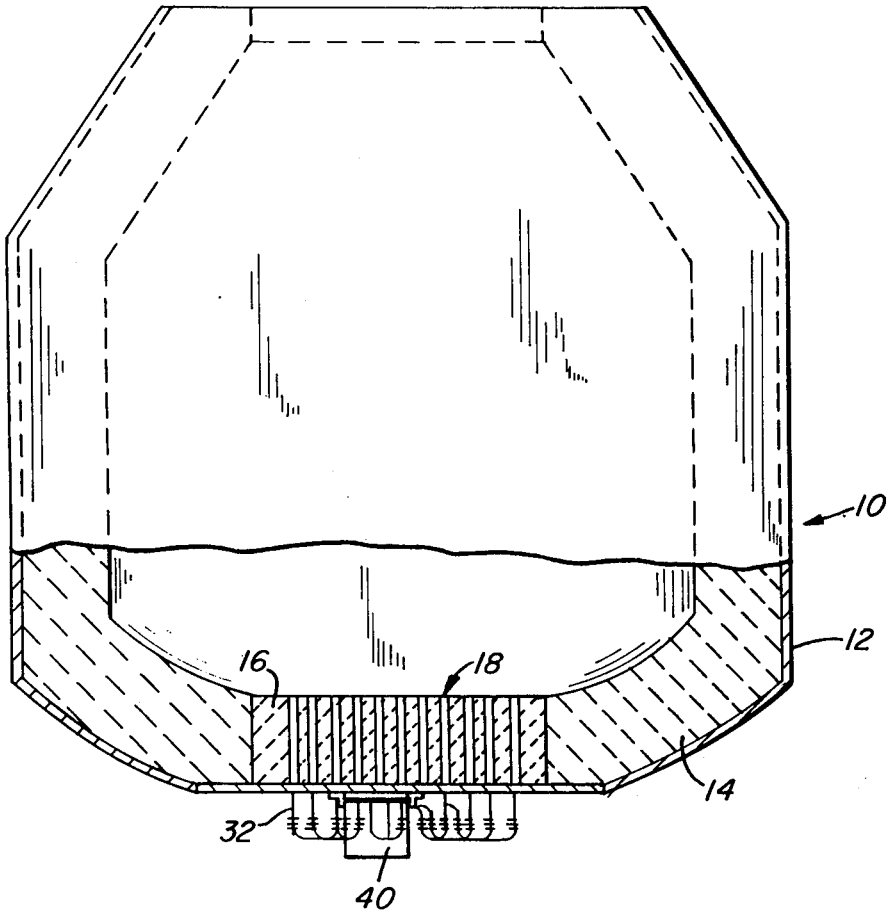
FIG. 1 is an elevational view, partly in section, of an oxygen steelmaking converter incorporating a distributor manifold of the present invention.
Figure 2:
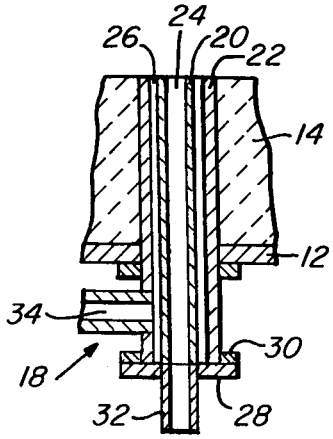
FIG. 2 is an elevational section of a tuyere utilized in the converter of FIG. 1.
Figure 3:
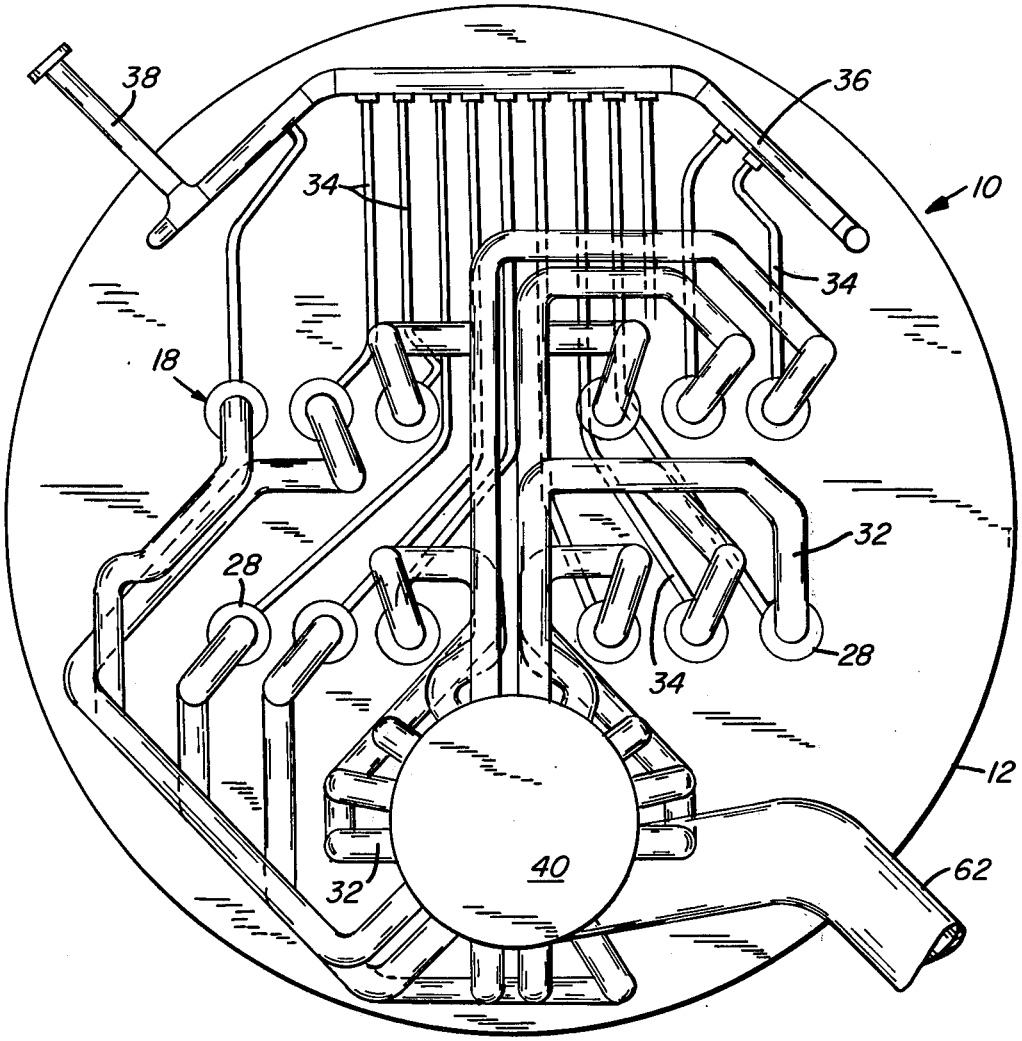
FIG. 3 is a bottom plan view, partly in section, of the converter of FIG. 1.

FIG. 1 illustrates a bottom-blown oxygen steelmaking converter vessel 10 comprising a shell 12 having a refractory lining 14 and a removable refractory bottom plug 16 containing a plurality of upstanding tuyeres 18. Each tuyere 18 consists of an inner tube 20 and a concentrically spaced outer tube 22 which cooperate to define an axial flow passage 24 and an annular flow passage 26. The bottom of each tuyere 18 is closed by a closure plate 28 secured to a flange 30 at the lower end of the outer tube 22. Feeder lines 32 penetrate the respective closure plates 28 and communicate with the axial passage 24 in each tuyere for supplying oxygen alone or a mixture of oxygen and particulate lime thereto. A second line 34 penetrates the outer tube 22 of each tuyere and communicates with the annular passage 26 for supplying shielding fluid such as propane, natural gas, or another hydrocarbon fluid to the tuyere 18 as is well known in the art. A manifold header 36 connected to a source of shielding fluid through supply line 38 supplies shielding fluid to each of the respective lines 34.

According to the present invention, the supply of refining fluid, consisting for example of oxygen alone or of a mixture of oxygen and entrained lime particles, to the respective feeder lines 32 is effected by means of distributor manifold 40. The manifold 40 comprises a hollow cylindrical body 42 attached to the bottom of the vessel shell 12 by means of brackets 44 that are circumferentially spaced about the upper end of the body. The opposite ends of the interior of the body 42 are closed by lower and upper closure plates, 48 and 50 respectively. Lower end closure 48 is a circular flat plate that is welded or otherwise sealedly connected about its periphery to the lower edge of the body 42. Upper end closure 50 is a generally spherically formed plate that is concave with respect to the body interior and sealedly connected about its periphery to the upper end edge of the body 42.

The interior of the body 42 contains a horizontal partition plate 52 that divides the interior into two vertically spaced chambers, designated upper chamber 54 and lower chamber 56. The plate 52 contains an axial opening 58 about which an upstanding open ended connector tube 60 is mounted. The upper end of the connector tube 60 is vertically spaced from the upper end closure 50 whereby fluid communication between the upper chamber 54 and lower chamber 56 is established.

Refining fluid is admitted to the upper chamber 54 through supply line 62 which penetrates the body wall to define a tangential inlet 64 whereby a spinning motion is imparted to the fluid that enters the chamber. A spiral ramp 66 extending laterally between the connector tube 60 and the interior surface of the body wall encircles the connector tube making about one full turn between the partition plate 52 immediately adjacent the inlet 64 and the top of the connector tube. That region of the upper chamber 54 located above the ramp 66 is termed the raceway 67.

Figure 5:
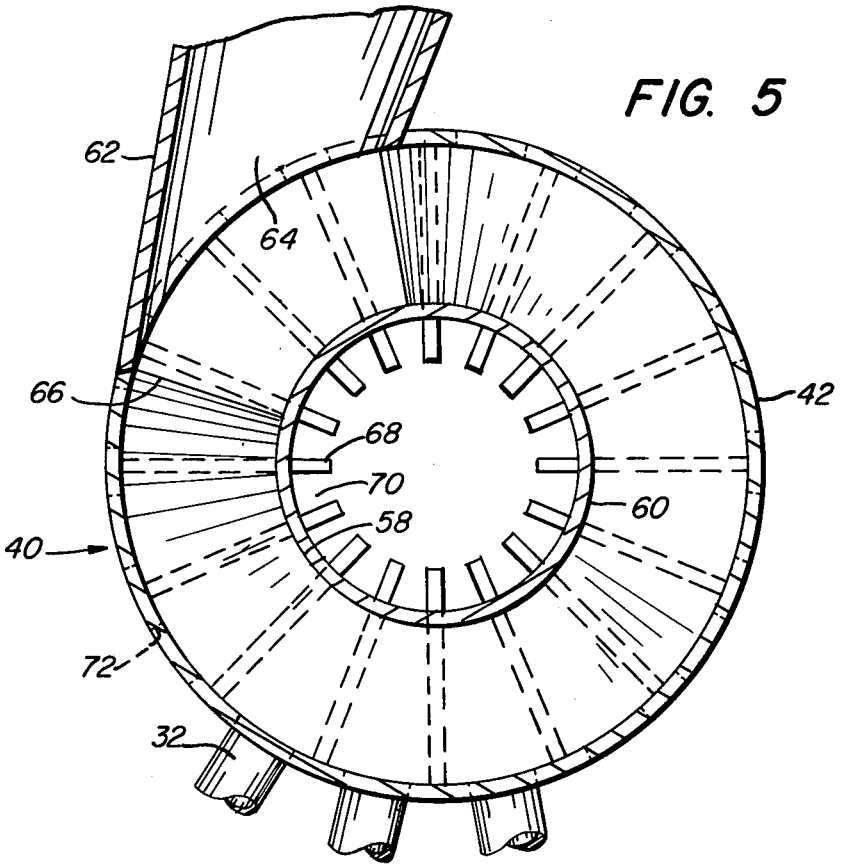
FIG. 5 is a sectional view taken along line 5—5 of FIG. 4.
Figure 4:
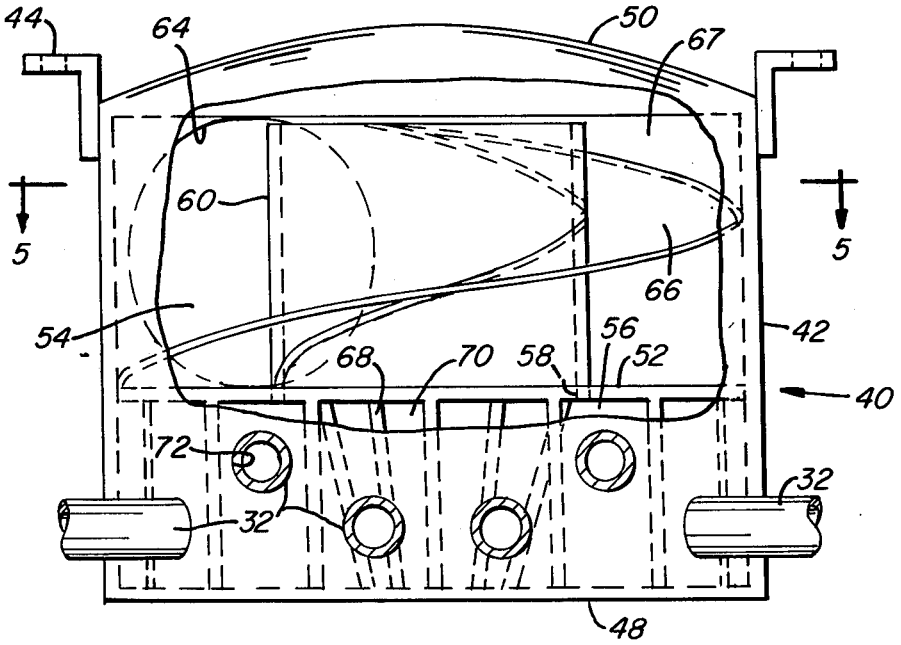
FIG. 4 is an elevational view of the distributor manifold of the present invention with part of the body wall removed.

The lower chamber 56 contains a plurality of radially extending, upstanding plates 68 that are substantially uniformly spaced about the circumference of the chamber and which define a plurality of distinct radial compartments 70. The compartments, as shown in FIG. 5, are open with respect to the interior of connector tube 60. Through-openings 72 penetrate the wall of the body 42 and communicate each with one of the compartments 70. Feeder lines 32 attach at one end to the exterior wall of the manifold body about each of the openings 72 whereby refining fluid from supply line 62 is distributed to each of the tuyeres 18.

The operation of the hereindescribed distributor manifold is as follows. Refining fluid, particularly fluid comprising a mixture of oxygen and entrained lime particles, is admitted from supply line 62 through tangential inlet 64 to the upper manifold chamber 54. Due to the cyclonic effect produced by the spinning motion induced in the fluid, it is caused to flow about the body wall enclosing the raceway 67. The natural tendency of the fluid is to enter the connector tube 60 through its upper end, this tendency being assisted by the concave shape of the upper end closure 50. From the tube 60, the fluid enters lower manifold chamber 56 where its rotary motion is transformed into radial flow through the compartments 70 by the obstructions presented by the radially inner ends of the partition plates 68. From the compartments 70, the fluid passes through the openings 72 in the wall of the body and enter the respective feeder lines 32 to be conducted to the axial passages 24 of the tuyeres 18.

In flowing between the tangential inlet 64 and the upper end of the connector tube 60, the fluid is prevented by the spiral ramp 66 from making more than one full turn between its entry and exit from the upper manifold chamber 54. Thus, there is no possibility of the flowing fluid to encroach upon the fluid flow at the inlet 64 and, concomitantly, no possibility of creating an increase in flow velocity that would tend to aggravate the abrasive effect of the lime particles on the interior surface of the manifold body.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A distributor manifold comprising a. a hollow cylindrical body;

b. means dividing the interior of said body into axially spaced portions;

c. means connecting said portions into mutual fluid communication;

d. inlet means for introducing supply fluid to one of said portions and for imparting a spinning motion therein whereby said fluid is induced by cyclonic action to traverse a path from said one portion through said connecting means to the other of said portions;

e. means for discharging supply fluid from the other of said portions; and f. baffle means diverting the path of fluid flow away from registry with supply fluid introduced through said inlet means.

2. Apparatus as recited in claim 1 in which said baffle means comprises a spiral ramp extending from said inlet means to the inlet of said connecting means.

3. Apparatus as recited in claim 2 in which said connecting means is an axial tube concentric with the wall of said body and about which said spiral ramp extends.

4. Apparatus as recited in claim 3 including a top wall closing the end of said one portion, the inlet end of said axial tube being axially spaced from said top wall and said top wall being arcuately formed.

5. Apparatus as recited in claim 2 in which said inlet means comprises duct means substantially tangentially disposed with respect to the wall of said body.

6. Apparatus as recited in claim 1 including a plurality of radial plates dividing said other of said portions into a plurality of separate compartments communicating each with said connecting means and a plurality of through-openings penetrating the wall of said body and communicating each with one of said compartments.

7. In a steel refining vessel having a plurality of tuyeres penetrating the bottom thereof for blowing a mixture of gas and solid particles upwardly into a molten charge within said vessel and feeder lines connecting with each of said tuyeres the improvement comprising a distributor manifold for supply of mixture to said feeder lines including:

a. a hollow, generally cylindrical body having closed ends attached to the bottom of said vessel;

b. plate means intermediate the ends of said body dividing the interior thereof into vertically spaced chambers;

c. a connecting tube open to both chambers connecting the same in mutual fluid communication;

d. inlet means for introducing said mixture to one of said chambers and for inducing a spinning motion therein whereby said mixture is induced by cyclonic action to flow from said one chamber through said connecting tube to the other of said chambers;

e. means connecting said feeder lines to said other chamber; and f. baffle means diverting the flow path of said mixture away from registry with the mixture passed through said inlet means.

8. Apparatus as recited in claim 7 in which said baffle means comprises a spiral ramp extending from said inlet means to the inlet of said connecting tube.

9. Apparatus as recited in claim 8 in which said connecting tube extends axially of said body and said spiral ramp is disposed intermediate said tube and the wall of said body.

10. Apparatus as recited in claim 9 in which the upper end of said connecting tube is vertically spaced from the upper end closure of said body and said end closure is concave with respect to said connecting tube upper end.

11. Apparatus as recited in claim 8 in which said inlet means comprises a duct communicating with the interior of said body and disposed substantially with respect to the interior wall thereof.

12. Apparatus as recited in claim 11 in which said duct communicates with the upper of said chambers.

13. Apparatus as recited in claim 7 including a plurality of radially extending, upstanding plates dividing the other of said chambers into a plurality of separate compartments each communicating with said connecting tube, and means forming openings in the wall of said body connecting each of said feeder lines in fluid communication with one of said compartments.

* * * * *